US008973479B2

(12) United States Patent
Wong

(10) Patent No.: US 8,973,479 B2
(45) Date of Patent: Mar. 10, 2015

(54) APPARATUS FOR CUTTING FOOD

(76) Inventor: Yan Kwong Wong, Hong Kong (HK)

( * ) Notice: Subject to any disclaimer, the term of this patent is extended or adjusted under 35 U.S.C. 154(b) by 1196 days.

(21) Appl. No.: 12/780,861

(22) Filed: May 14, 2010

(65) Prior Publication Data

US 2010/0326291 A1 Dec. 30, 2010

(30) Foreign Application Priority Data

May 15, 2009 (CN) ..... 2009 2 0154995 U
Oct. 29, 2009 (CN) ..... 2009 2 0269844 U

(51) Int. Cl.
*B26D 1/00* (2006.01)
*B26D 1/02* (2006.01)
*B26D 3/28* (2006.01)

(52) U.S. Cl.
CPC ..... *B26D 3/283* (2013.01); *B26D 2003/286* (2013.01); *B26D 2003/287* (2013.01); *B26D 2003/288* (2013.01); *Y10S 83/932* (2013.01)
USPC ..... 83/856; 83/35; 83/932

(58) Field of Classification Search
USPC ..... 83/821, 825, 826, 856–858, 932, 35
See application file for complete search history.

(56) References Cited

U.S. PATENT DOCUMENTS 5,445,332 A * 8/1995 Shimizu et al. ..... 241/100
7,107,890 B2 * 9/2006 Vincent ..... 83/247
2004/0200366 A1 * 10/2004 Koerselman et al. ..... 99/537
2004/0231482 A1 * 11/2004 Boilen ..... 83/425.3

* cited by examiner

*Primary Examiner* — Kenneth E. Peterson
*Assistant Examiner* — Samuel A Davies
(74) *Attorney, Agent, or Firm* — Gloria Tsui-Yip; ;Miskia & Tsui-Yip LLP

(57) ABSTRACT

This invention relates to an apparatus for cutting food comprising a rack and a knife rest set on the rack and further comprising: a nipper for gripping food. A slideway is designed on the rack, provided with a slide rail and a guide rail that match each other between the slideway and the bottom of the nipper. The nipper for gripping food of the food cutter avoids sliding along the slideway with hands directly holding food to effectively prevent hands from being scratched by the knife rest and provide safer and more labor-saving use. Moreover, the slide rail and the guide rail that match each other between the slideway and the bottom of the nipper prevent the nipper from deviating when sliding along the slideway for more labor-saving use. This invention further discloses that it is a food cutter that can cut food into more shapes.

8 Claims, 11 Drawing Sheets

APPARATUS FOR CUTTING FOOD

This application claims the priority of Chinese Application No. 200920154995.1, filed May 15, 2009, and the priority of Chinese Application No. 200920269844.0, filed Oct. 29, 2009.

FIELD OF THE INVENTION

This invention relates to a kitchenware, and particularly to a food cutter that can cut food into various shapes.

BACKGROUND OF THE INVENTION

To prepare vegetable salads or cook dishes, the food needs to be cut into slices or pieces or bars, and kitchen knifes or slicers or shredders are usually used. Slicing or shredding food with kitchen knifes is slow, and the thickness of the sliced or shredded food may be different. Slicers or shredders can ensure sliced or shredded food has the same thickness. However, the current slicers or shredders can provide a single shape of food only, such as slice or shred, and the shape can't be adjusted; in addition, the use is strenuous and not very safe as hands may be scratched easily. The technical problem this invention is intended to solve is the provision of a more labor-saving and safer food cutter aiming at the unsafe use of the shredders or slicers using the prior technique.

SUMMARY OF THE INVENTION

The technical scheme adopted by this invention to solve its technical problem is: to construct a food cutter, comprising: a rack and blade carriers set on the rack, and further comprising: a handguard for gripping food, with the said rack being provided with a slideway, with guides and slides that match each other set between the slideway and the bottom of the handguard.

In the food cutter according to this invention, the said handguard comprises a handguard base and a food storage mechanism set on the handguard base, and the said slides are set beneath the handguard base.

In the food cutter according to this invention, the said slide rails are provided with trolleys between the slide rails and the guide rails. The trolleys can reduce the friction between the slide rails and the guide rails, so that the operation is more labor-saving.

In the food cutter according to this invention, an outer fixed sleeve is fixed on the said handguard base, the said food storage mechanism comprises an inner rotating cylinder set inside the outer fixed sleeve that can slide axially along the outer fixed sleeve and a feeder positioned on the inner rotating cylinder, and steel needles that can stab in food are installed inside the said inner rotating cylinder. To fill food, the user just takes out the inner rotating cylinder from the outer fixed sleeve, without taking out the whole handguard from the slides, thus provides more convenient operation.

In the food cutter according to this invention, the said feeder comprises a connecting rod and a gland and a push-tray fixed on two ends of the connecting rod; the said connecting rod penetrates through the connecting hole set at the end of the said inner rotating cylinder; the said gland is located outside the inner rotating cylinder; the said push-tray is assembled inside the inner rotating cylinder; and the said push-tray is provided with needle holes for the steel needles passing through. The feeder feeds food continuously during food cutting, so that the whole food storage mechanism can grip more food at a time, thus reduces the number of food fillings and provides easier operation.

In the food cutter according to this invention, between the said outer fixed sleeve and the inner rotating cylinder is an outer rotating cylinder that can rotate relatively to the outer fixed sleeve and can axially slide relatively to the inner rotating cylinder; as well as an angle adjusting mechanism, provided with an index plate set at the extension of the outer rotating cylinder and a stop set on the guides that prods the said index plate to rotate. The angle adjusting mechanism makes the inner rotating cylinder that grips food able to rotate by a certain angle when the handguard slides along the slideway, thus the same food cutter can cut food into more shapes.

In the food cutter according to this invention, the said guides are provided with a retractable stop component that prods the said index plate to rotate, comprising a positioning pillar that can extend out of the guide rails, a push rod that uplifts the positioning pillar, and a spring set between the positioning pillar and the rack that makes the positioning pillar relocatable. Thus the angle adjusting mechanism can provide more angle values, and the number of shapes of resulted food is further increased.

In the food cutter according to this invention, the said index plate is provided with at least one step that matches the said stop component. The step can further increase the number of angle values the angle adjusting mechanism can provide and further increase the number of shapes of resulted food.

In the food cutter according to this invention, the said rack further comprises a support and supporting legs installed beneath the support, and the said slideway is installed above the support.

In the food cutter according to this invention, the said supporting legs comprise a supporting tube designed at the front end of the support and supporting pillars designed at the rear end of the support.

In the food cutter according to this invention, non-slip mats are set at the bottoms of the said supporting tube and the supporting pillars.

In the food cutter according to this invention, a positioning groove is designed on the lower part of the said support that is hung on the container wall.

The use of this invention has the following beneficial effect: the handguard for gripping food of the food cutter can avoid sliding back and forth along the slideway with the hand directly holding food to effectively prevent the hand from being scratched by blade carriers and provide safer use. In addition, the guide rails and the slide rails that match each other between the slideway and the bottom of the handguard prevent the handguard from deviating when sliding along the slideway, that is the positions of the blade carriers and the food vertical to the slideway will not change significantly, thus ensures the shapes of resulted food are regular. Furthermore, when the handguard is being operated, no force is needed to precisely control the sliding direction of the handguard, thus provides more labor-saving use.

DETAILED DESCRIPTION OF THE INVENTION

Figure 1:
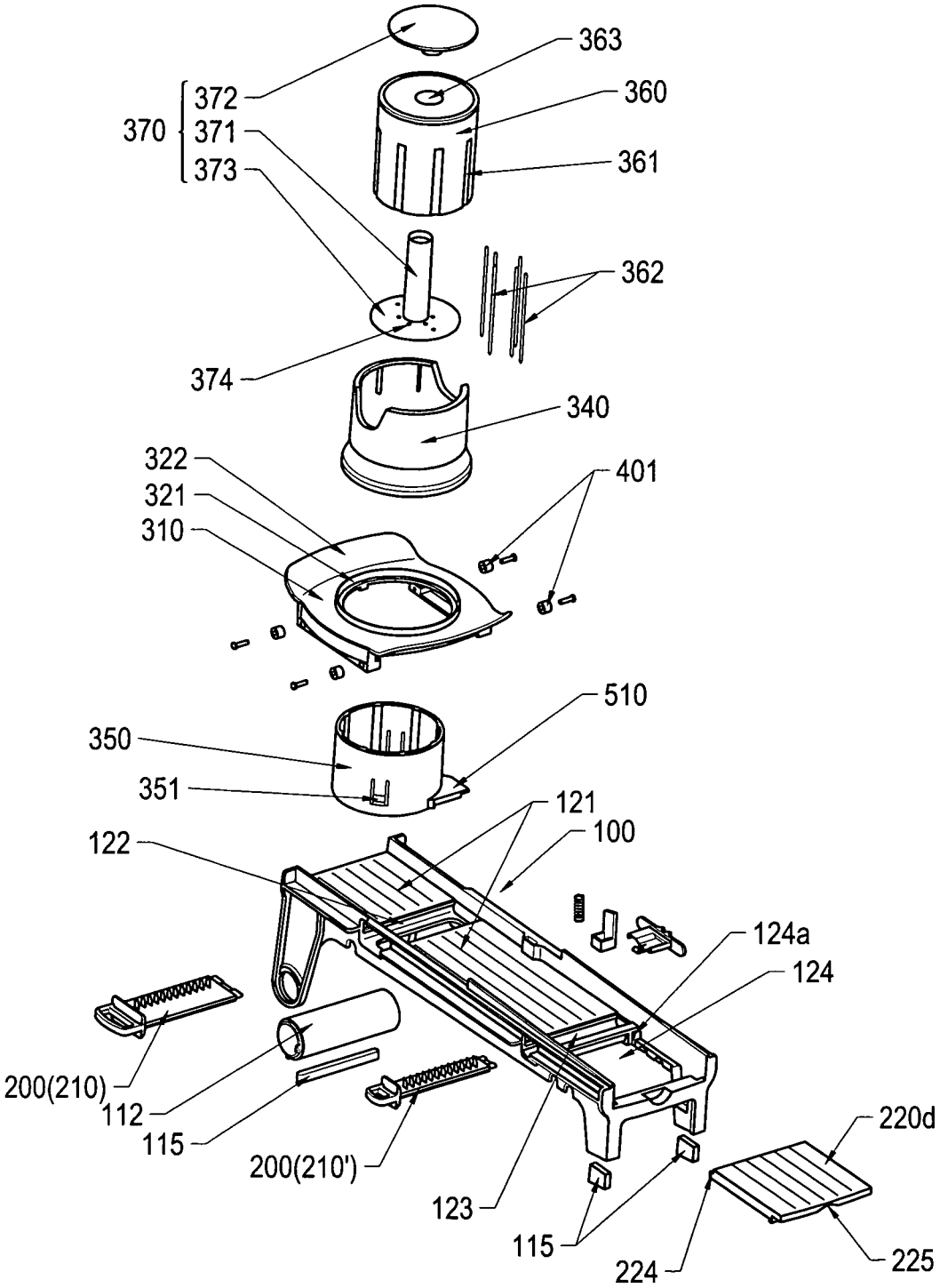
FIG. 1 is an explosive view of the food cutter according to this invention.

As shown in FIGS. 1, 2, 3 and 4, the food cutter according to this invention comprises a stander 100, blade carriers 200, and a handguard 300 for gripping food. Wherein the rack 100 comprises a support 110 and a slideway 120 set on the support 110, with the blade carriers 200 located on the slideway 120 and the handguard 300 being able to slide back and forth along the slideway 120. Thus when the handguard 300 gripping food slides along the slideway 120, the food can be cut by the blade carriers 200 located on the slideway 120 into slices or shreds in all shapes.

Figure 2:
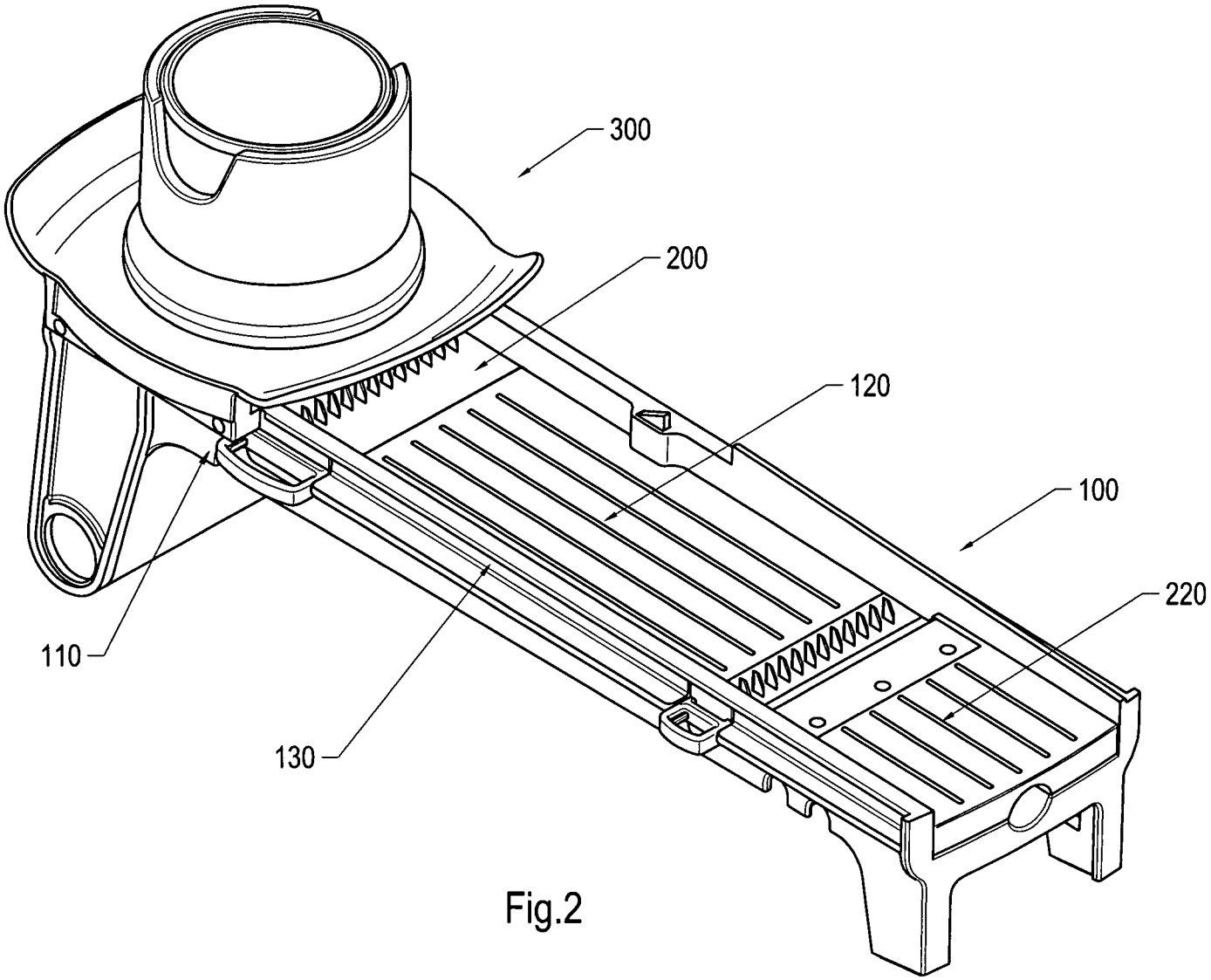
FIG. 2 is a space diagram of the food cutter according to this invention.
Figure 3:
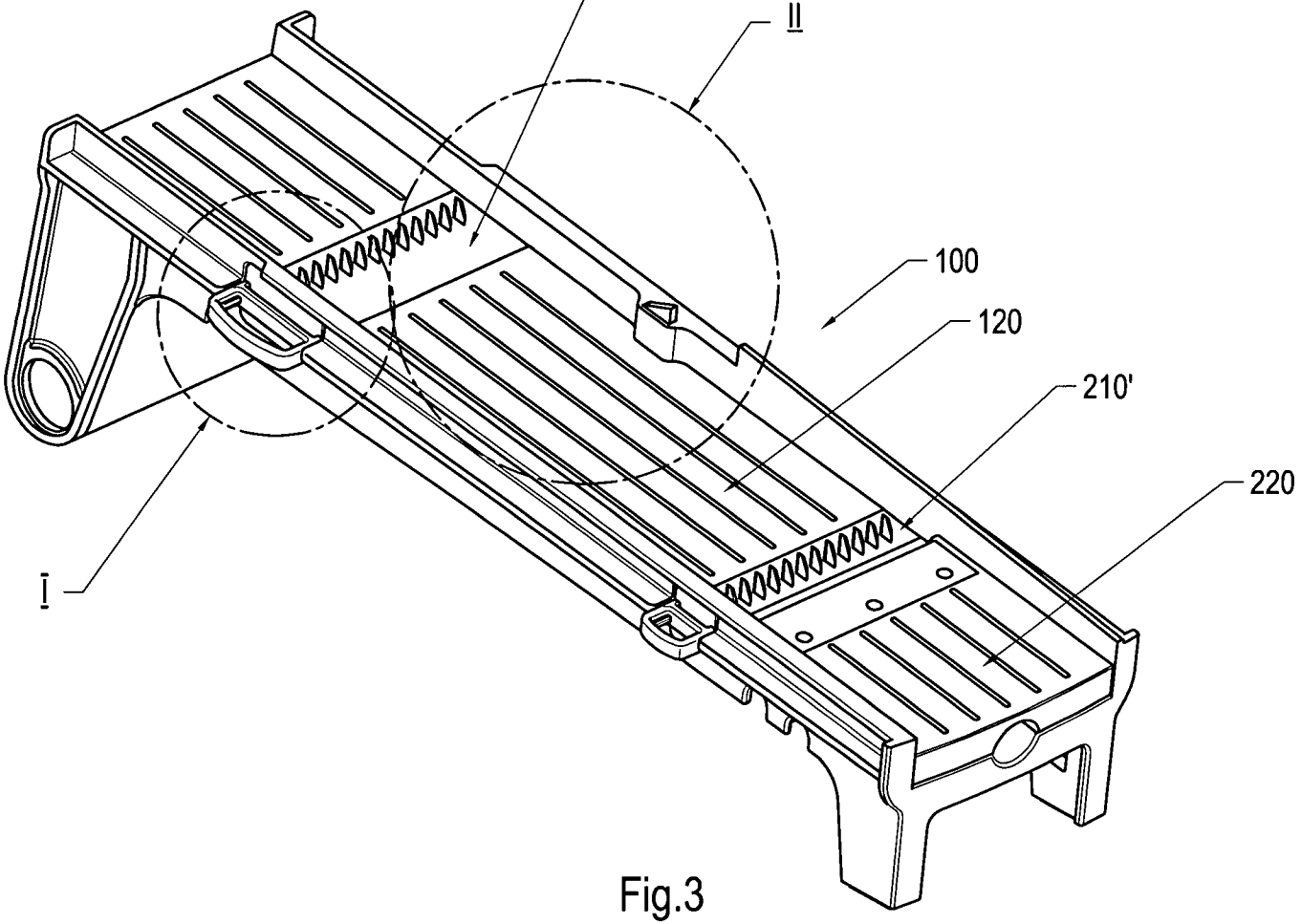
FIG. 3 is a space diagram of the rack of the food cutter according to this invention.
Figure 4:
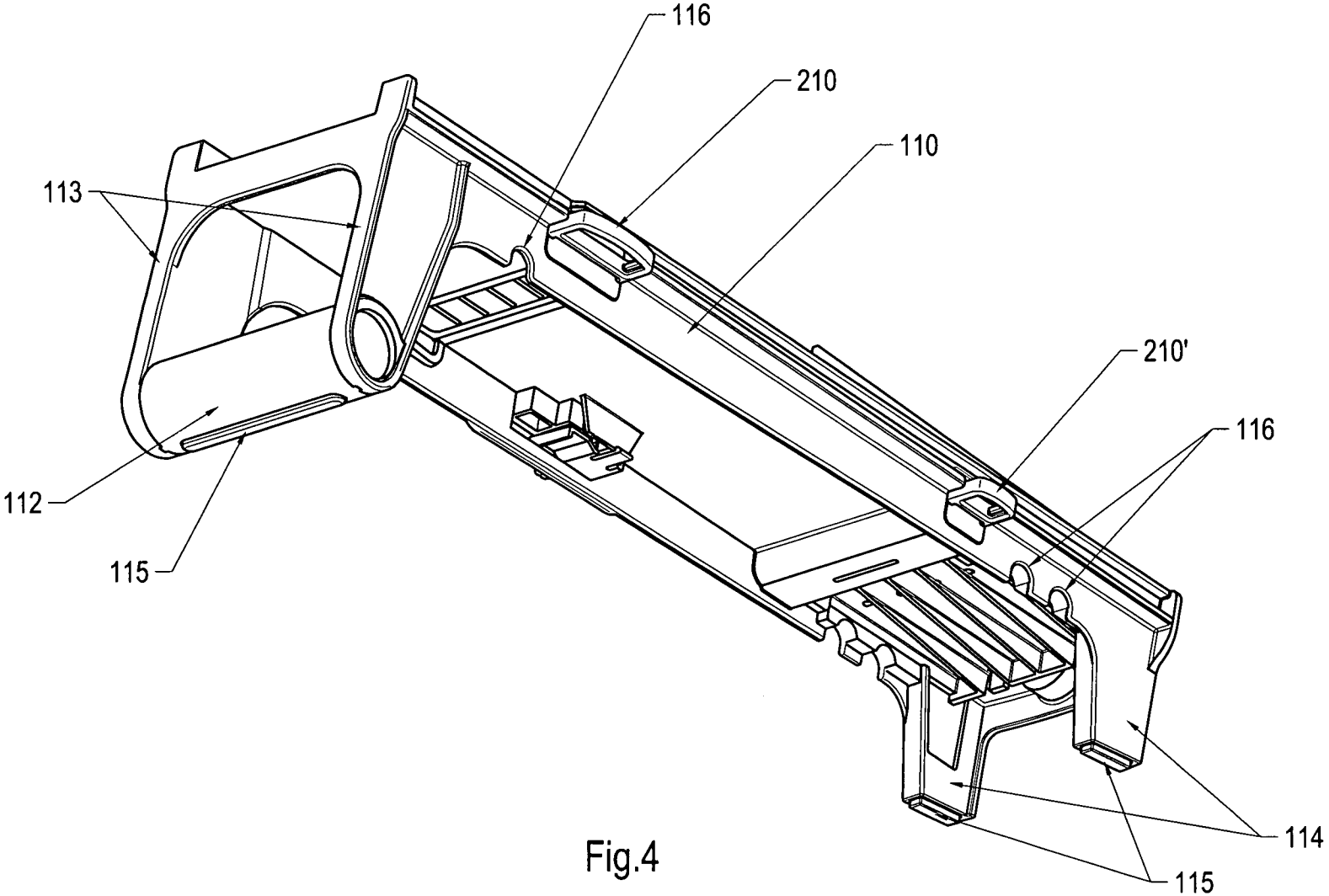
FIG. 4 is a 3 dimensional diagram of another side of the rack of the food cutter according to this invention.

Particularly, as shown in FIGS. 2, 3 and 4, the slideway 120 preferredly consists of a panel, and two parallel guide rails 130 are installed on two sides of the slideway 120. A number of raised long and thin fillets 121 can be set on the surface of the panel. The fillets 121 are parallel to the guide rails 130, and play the role of guiding when food slides along the surface of the panel, thus reduces the slide resistance of the food on the panel and provides more labor-saving operation.

Figure 14A:
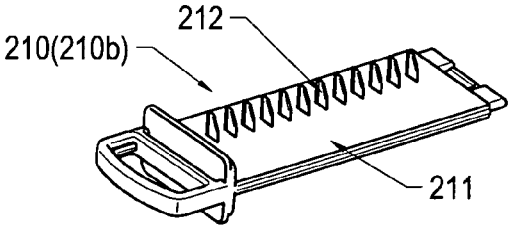
FIG. 14*a* is a structure diagram of the front teeth blade carrier of the food cutter according to this invention.
Figure 14B:
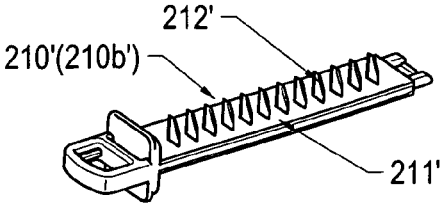
FIG. 14*b* is a structure diagram of the rear teeth blade carrier of the food cutter according to this invention.
Figure 14C:
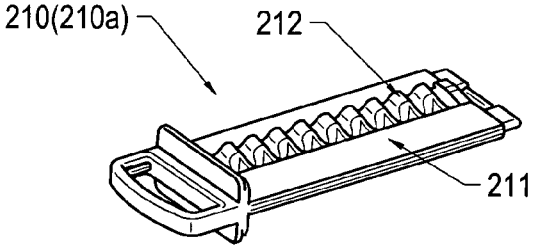
FIG. 14*c* is a structure diagram of the front wave blade carrier of the food cutter according to this invention.
Figure 14D:
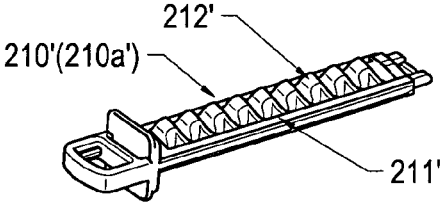
FIG. 14*d* is a structure diagram of the rear wave blade carrier of the food cutter according to this invention.

In this preferred case, a front blade carrier 210 and a rear blade carrier 210' are installed vertical to the guide rails 130 on the slideway 120. Each of the front blade carrier 210 and the rear blade carrier 210' consists of a blade board 211 and blade edges 212 fixed on the blade board with fasteners. Particularly, a front slot 122 and a rear slot 123 can be set vertical to the guide rails 130 on the slideway 120, with the blade board 211 of the front blade carrier matching the front slot 122, so that the blade board 211 of the front blade carrier can be exactly inserted into the front slot 122 and the plane of the blade board 211 is parallel and level to the slideway 120; and with the blade board 211' of the rear blade carrier matching the rear slot 123, so that the blade board 211' of the rear blade carrier can be exactly inserted into the rear slot 123 and the plane of the blade board 211' is parallel and level to the slideway 120. The blade edges 212, 212' of the front blade carrier and the rear blade carrier can be set to the shape of wave or teeth as required to form the front wave blade carrier 210*a* as shown in FIG. 14*c*, the front teeth blade carrier 210*b* as shown in FIG. 14*a*, the rear wave blade carrier 210*a*' as shown in FIG. 14*d*, and the rear teeth blade carrier 210*b*' as shown in FIG. 14*b*.

Figure 14E:
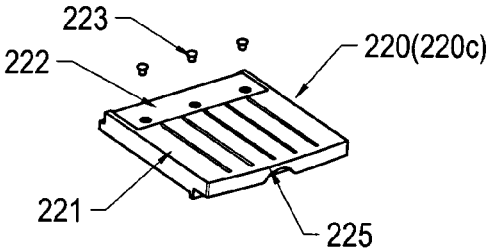
FIG. 14*e* is a structure diagram of the lower flat blade carrier of the food cutter according to this invention.
Figure 14F:
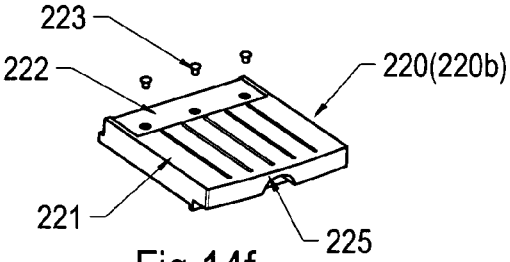
FIG. 14*f* is a structure diagram of the upper flat blade carrier of the food cutter according to this invention.
Figure 14G:
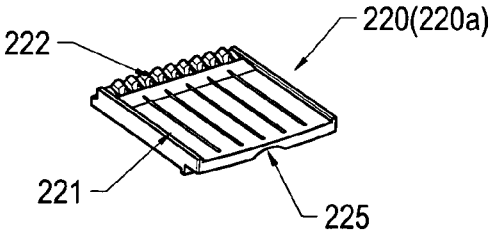
FIG. 14*g* is a structure diagram of the auxiliary wave blade of the food cutter according to this invention.

An auxiliary blade carrier 220 can also be set at the end of the slideway 120 of the rack, and similarly the auxiliary blade carrier 220 consists of a blade board 221 and blade edges 222 fixed on the blade board 221 with fasteners 223. Particularly, a nick 124 is set at the end of the slideway 120 of the rack, with the blade board 221 of the auxiliary blade carrier matching the nick 124, so that the blade board 221 can be exactly embedded into the nick 124 of the slideway to ensure the whole slideway 120 is continuous; and with a buckle 224 and a trough 124*a* that match each other set between the blade board 221 of the auxiliary blade carrier and the nick 124 of the slideway, so that the blade board 221 can be snapped in the nick 124, without shift from the nick 124. In order to remove the auxiliary blade carrier 220 easily, a groove 225 can be installed at the end of the blade board 221 of the auxiliary blade carrier, as the buckle 224 can be separated from the trough 124*a* when the user's hand reaches inside the groove 225 and pushes the blade board 221 upwards, thus removes the auxiliary blade carrier 220, which is convenient for replacing the auxiliary blade carrier. The blade edges 222 of the auxiliary blade carrier can be set to the shape of wave or flat plate as required to form the auxiliary wave blade carrier 220*a* as shown in FIG. 14*g* and the auxiliary flat blade carrier, and the height of the blade board of the auxiliary flat blade carrier can be set as required to form the upper flat blade carrier 220*b* as shown in FIG. 14*f* and the lower flat blade carrier 220*c* as shown in FIG. 14*e*. FIG. 14*f* is a structure diagram of the upper flat blade carrier of the food cutter according to this invention.

As shown in FIG. 1, an auxiliary flat plate 220*d*, instead of blade carriers, can be set in the nick 124 of the slideway according to the requirement of combination. The auxiliary flat plate 220*d* matches the nick 124, so that the auxiliary flat plate 220*d* can exactly fill the nick 124 of the slideway 120 to ensure the whole slideway 120 is continuous.

Thus the whole slideway 120 of the rack is provided with three sets of blade carriers, and when the handguard 300 slides back and forth on the different sections of the slideway 120, food can be cut into different shapes. If the front wave blade carrier 210*a* is inserted into the front slot 122, as the blade edges have the shape of wave, when the handguard 300 gripping food slides back and forth near the front slot 122 on the slideway 120, the food will have a wave shape. If the upper flat blade carrier 220*b* or the lower flat blade carrier 220*c* is placed in the nick 124, due to the difference in the height of the blade edges, when the handguard 300 gripping food slides back and forth near the nick 124 on the slideway 120, the food can be cut into slices of different degrees of thickness.

If the rear teeth blade carrier 210*b*' is inserted into the rear slot 123 and the auxiliary flat blade carrier is placed in the nick 124 of the slideway 120, when the handguard 300 gripping food slides back and forth near the rear slot 123 and the nick 124 on the slideway 120, the rear teeth blade carrier 210*b*' can cut the food into equally spaced bars on and the bars are cut off with the auxiliary flat blade carrier, thus forms food bars of the same size and length.

Figure 5:
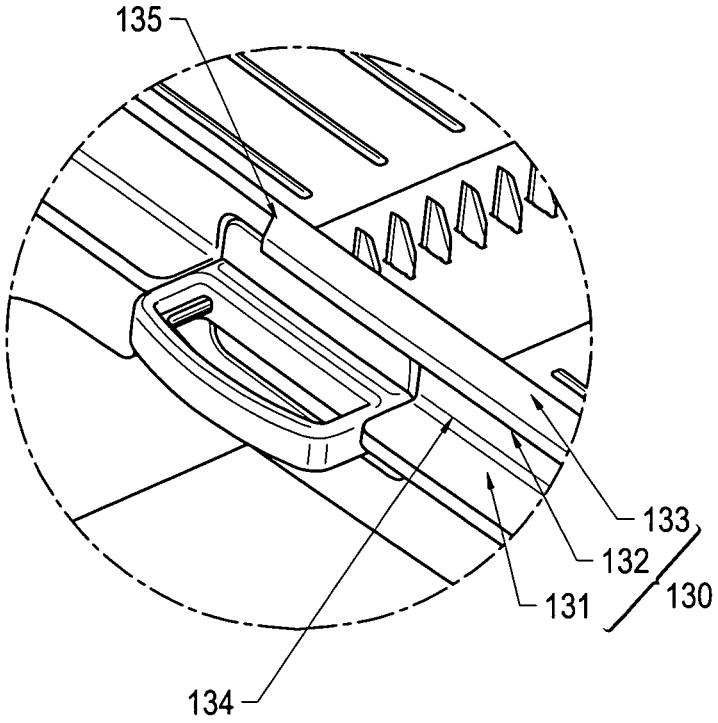
FIG. 5 is an enlarged view of Part I of FIG. 3.
Figure 9:
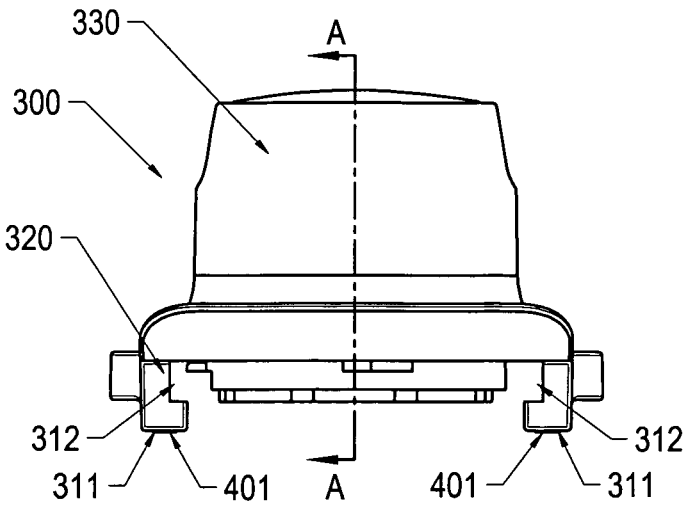
FIG. 9 is a front view of the handguard of the food cutter according to this invention.
Figure 10:
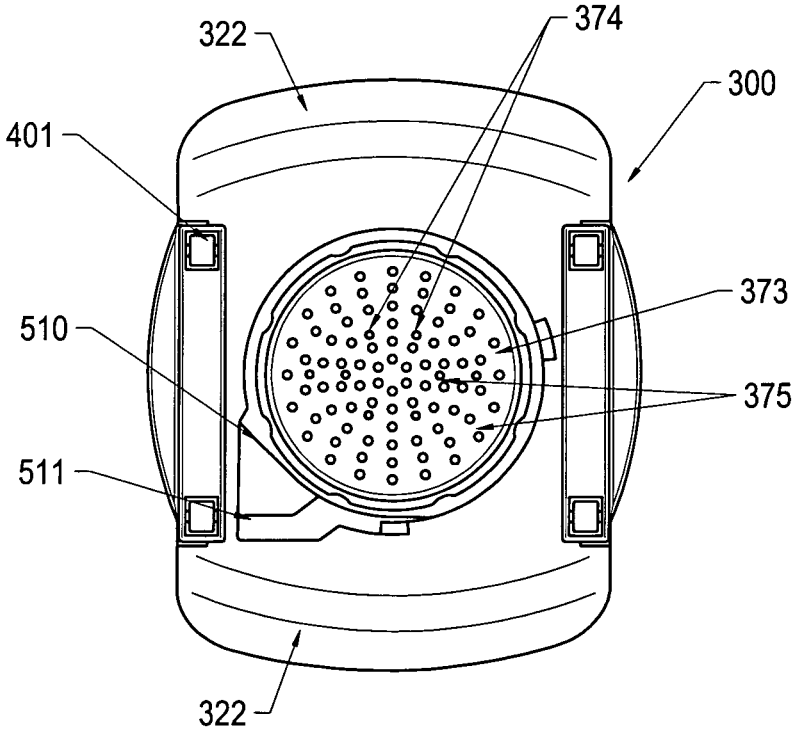
FIG. 10 is an upward view of FIG. 9.
Figure 11:
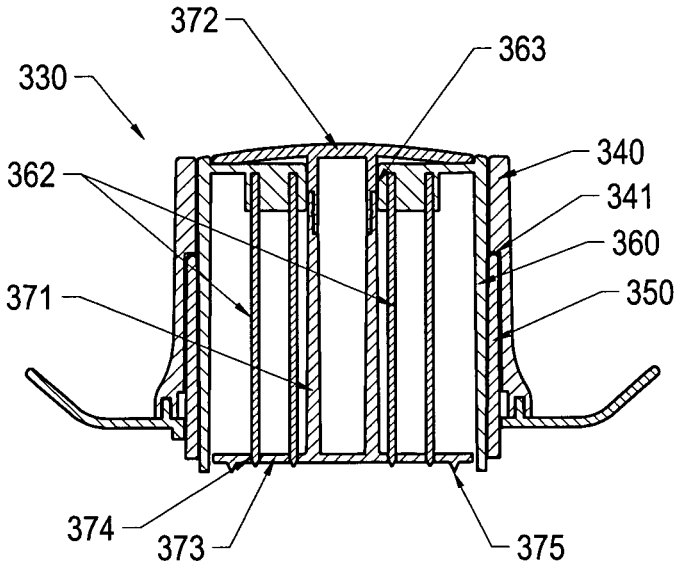
FIG. 11 is an A-A sectional view of FIG. 9.
Figure 12:
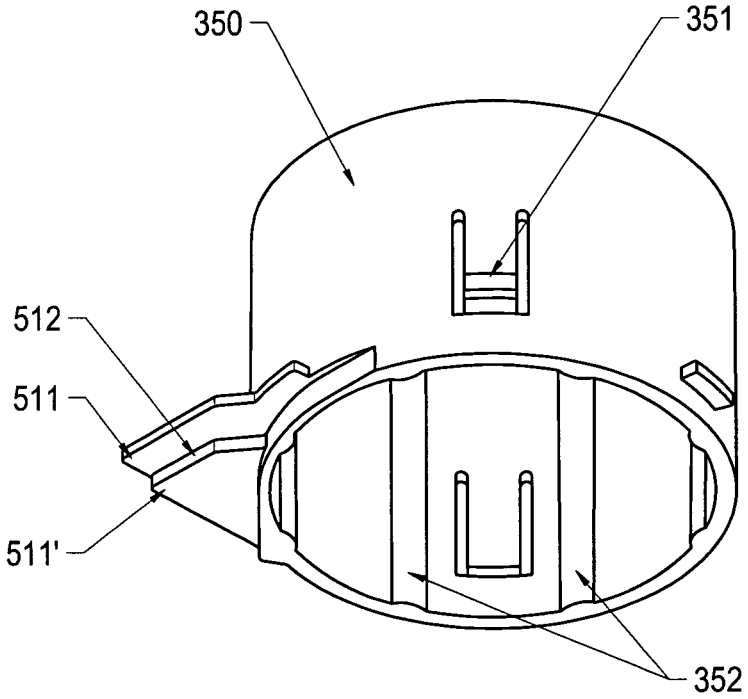
FIG. 12 is a 3 dimensional diagram of the outer rotating cylinder in the preferred case of the food cutter according to this invention.

As shown in FIGS. 5, 7, 8, 9, 10, 11 and 12, in this preferred case, the handguard 300 is provided with slide rails 310 at the bottom, and the said slide rails 310 match the guide rails 130, so that the handguard 300 can slide back and forth along the two guides 130. As shown in FIG. 5, the section of the said guide rails 130 has the shape of half "I", and comprises a horizontal bearing surface 131, a vertical baffle surface 132 and a horizontal groove surface 133, with the space between the horizontal bearing surface 131 and the horizontal groove surface 133 forming a guide groove 134. The handguard 300 comprises a handguard base 320 and a food storage mechanism 330. As shown in FIG. 9, the said slides 310 are set at the bottom of the handguard base 320, comprising a bottom bearing surface 311 in contact with the horizontal bearing surface 131 of the guides and a slide groove 312 that matches the horizontal groove surface 133 of the guides, with the bottom bearing surface 311 of the slides extending into the guide groove 134 and the horizontal groove surface 133 of the guides extending into the slide groove 312, so that the slide rails 310 and the guide rails 130 embed and match each other and the slides 310 can slide along the guide rails 130 only, without rotation or shift in other direction, thus ensures the handguard 300 slides back and forth on the slideway 120 along the guide rails 130 very smoothly. It would be best to set trolleys 401 between the slide rails 310 and the guide rails 130. As shown in FIG. 10, in this preferred case, each slide rail 310 is provided with two trolleys 401, so that when the handguard 300 slides back and forth along the slideway 120, the friction coefficient between the slide rails 310 and the guides 130 is smaller, thus the force for operating the handguard 300 is reduced and the operation is easier and more labor-saving. As shown in FIG. 5, in order to mount the handguard base 320 on the guide rails 130, an opening 135 is set at the front end of the guide rails 130, that is the opening 135 is set on the horizontal groove surface 133 of the guide rails 130, so that the bottom bearing surface of the slide rails 310 of the handguard base 320 can enter the space between the horizontal bearing surface 131 and the horizontal groove surface 133 of the guides from the opening 135, thus the slide rails 310 and the guide rails 130 can intersect and coordinate each other. FIG. 13*b* is a state diagram of the index plate-of the food cutter according to this invention when it is in the second position.

In this preferred case, an outer fixed sleeve 340 is fixed on the handguard base 320, and the said food storage mechanism 330 is set inside the outer fixed sleeve 340, comprising an outer rotating cylinder 350 and an inner rotating cylinder 360. The handguard base 320 is provided with a through-hole 321; the outer fixed sleeve 340 is fixed at the through-hole 321 of the handguard base; and the diameter of the through-hole 321 equals to the inner diameter of the outer fixed sleeve 340. The outer rotating cylinder 350 is set inside the outer fixed sleeve 340; the outer fixed sleeve 340 is provided with a step 341 on the side wall near the handguard base 320; and the outer rotating cylinder 350 is provided with two retainers 351 in the corresponding positions on the outer side wall. The outer rotating cylinder 350 is inserted into the outer fixed sleeve 340 from one end of the handguard base 320, and the retainers 351 are exactly snapped in the step 341 on the inner side wall of the outer fixed sleeve 340, thus the outer rotating cylinder 350 is prevented from axially moving inside the outer fixed sleeve 340, but can rotate relatively to the outer fixed sleeve 340. The inner rotating cylinder 360 is set inside the outer rotating cylinder 350, and ribs 352 and grooves 361 that match each other are set on the coordinative cylindrical surface between the inner rotating cylinder 360 and the outer rotating cylinder 350, so that when the inner rotating cylinder 360 is inserted into the outer rotating cylinder 350, the inner rotating cylinder 360 can rotate together with the outer rotating cylinder 350. Steel needles 362 that can stab in food are set inside the inner rotating cylinder 360. The food is mounted on the steel needles 362 of the inner rotating cylinder, and the inner rotating cylinder 360 is inserted into the outer rotating cylinder 350 and extends beneath the handguard base 320 through the through-hole 321 from the bottom of the outer fixed sleeve 340. When the handguard 300 is pushed to slide on the slideway 120 of the rack, the food stabbed by the steel needles 362 of the inner rotating cylinder of the food storage mechanism can be cut by the blade carriers located on the slideway 120 into various shapes.

Figure 7:
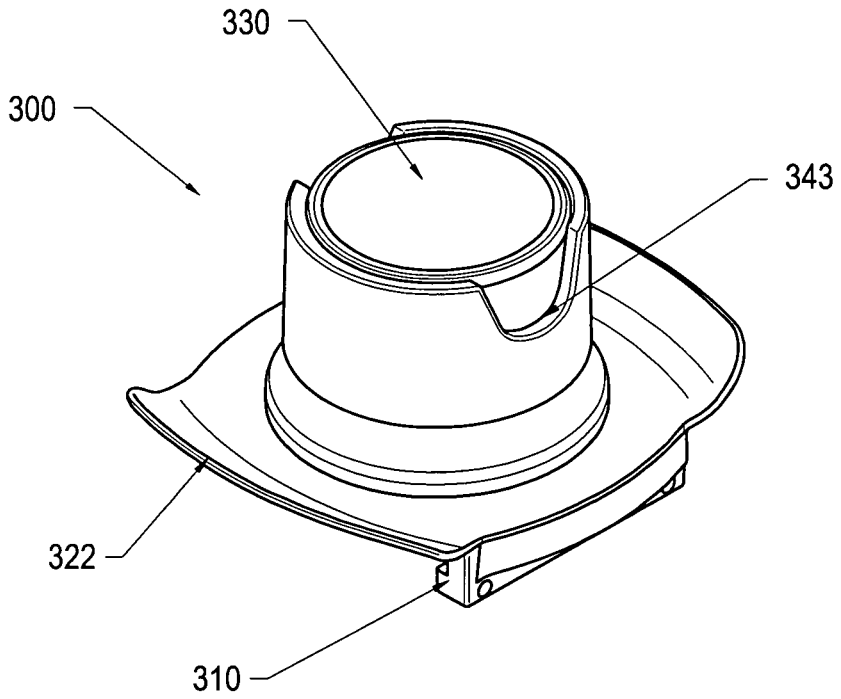
FIG. 7 is a space diagram of the handguard of the food cutter according to this invention.
Figure 8:
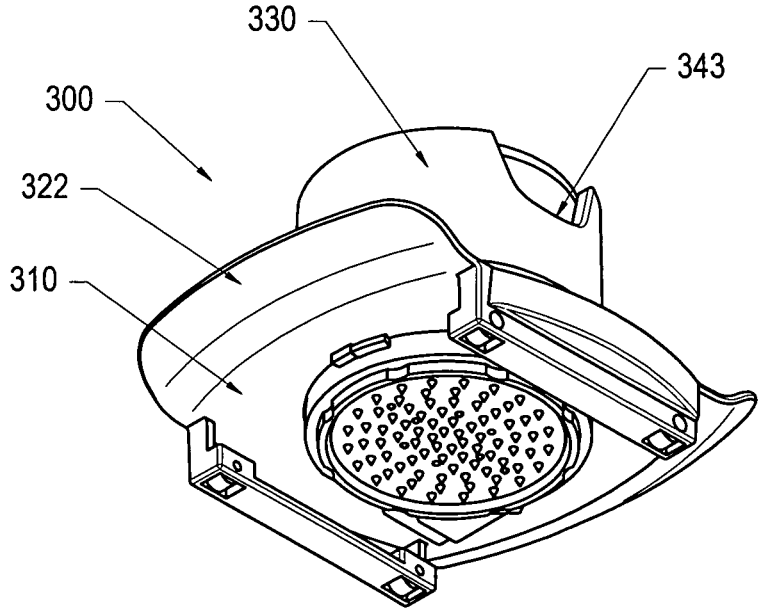
FIG. 8 is a 3 dimensional diagram of another side of the handguard of the food cutter according to this invention.

In order to avoid the need to continuously adjust the position of food, a feeder 370 is also set on the inner rotating cylinder 360. The feeder 370 comprises a connecting rod 371, a gland 372, and a push-tray 373, with the two ends of the connecting rod 371 connected with the gland 372 and the push-tray 373 respectively, particularly with a fixed connection between the connecting rod 371 and the push-tray 373, and a threaded connection between the connecting rod 371 and the gland 372, so that the whole feeder 370 can be assembled/disassembled on/from the inner rotating cylinder 360 easily. The central section of the connecting rod 371 passes through the connecting hole 363 set at the end of the inner rotating cylinder 360, and the push-tray 373 is located inside the inner rotating cylinder 360 and is provided with needle holes 374 that match the steel needles 362. The food storage mechanism 330 is taken out; the end provided with the push-tray 373 is pressed down toward the food; the push-tray 373 is pushed into the inner rotating cylinder 360; and the steel needles stab in the food, thus the food is gripped inside the inner rotating cylinder 360. When the handguard 300 is assembled and cutting begins, the gland 372 of the feeder can be pushed inward continuously to drive the push-tray 373 to push the food from the inner rotating cylinder 360, thus sends out the food to the slideway 120 continuously to provide easier and quicker operation. As shown in FIG. 10, it would be best that uniformly distributed short thrusts 375 are set on the surface of the push-tray 373 to stab in food, so that the food can be gripped more steadily and reliably. As shown in FIG. 7, in order to easily take out the inner rotating cylinder 360 to supplement food, two gaps 343 are set up on the side wall of the outer fixed sleeve 340, so that the inner rotating cylinder 360 can be easily taken out of the outer rotating cylinder 350 with the hand.

In order to protect fingers during cutting, a protective flange 322 is installed around the handguard base 320, thus shelters the fingers of the user to prevent contact between the fingers and the blade edges during use and prevent the fingers from being injured.

Figure 15:
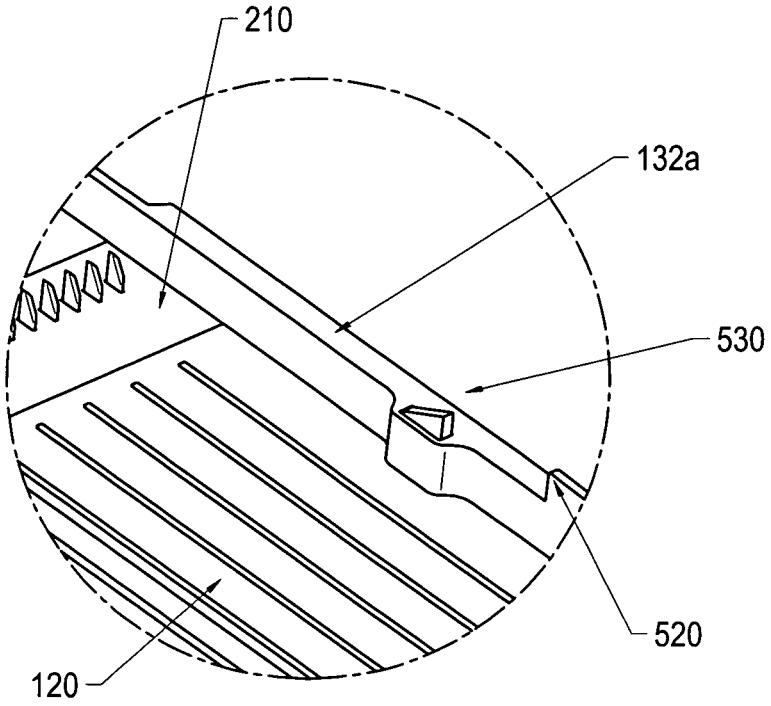
FIG. 15 is a magnified view of Part II of FIG. 3.

In order to cut food into more shapes, the food cutter in this preferred case is also provided with an angle adjusting mechanism. As shown in FIGS. 1, 3, 6, 10, 12 and 15, the angle adjusting mechanism comprises an index plate 510 installed on the outer rotating cylinder and a stop 520 installed on the guides. The index plate 510 is fixed at the extension of the outer rotating cylinder 350 near the handguard base, and can drive the outer rotating cylinder 350 to rotate together inside the outer fixed sleeve 340. As shown in FIG. 15, the said stop 520 is the end point on the gap 132*a* installed on the vertical baffle surface 132 of the guides 130. The index plate 510 is designed to have proper thickness, so that when the handguard base 320 slides on the guides 130, the upper surface of the vertical baffle surface 132 of the guides is lower than the bottom of the handguard base 320, and higher than the lower surface of the index plate 510 at the extension of the outer rotating cylinder.

Figure 13A:
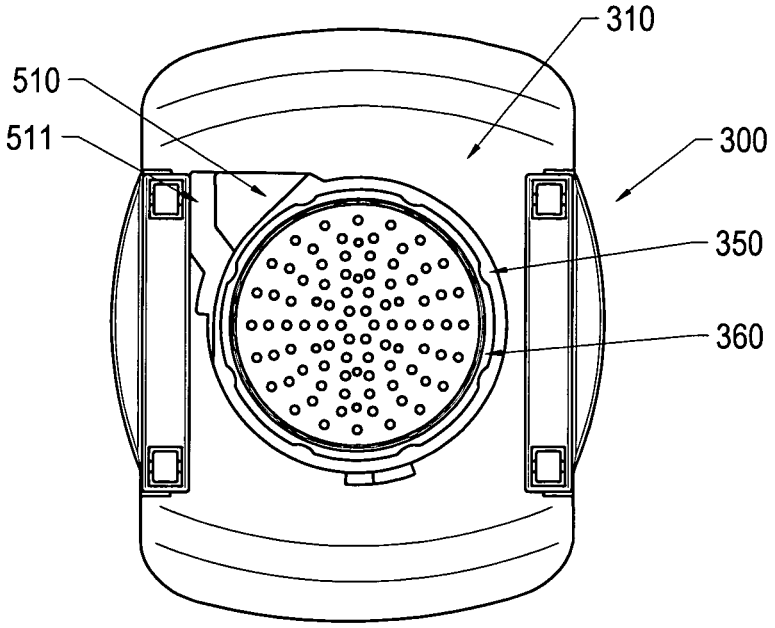
FIG. 13*a* is a state diagram of the index plate of the food cutter according to this invention when it is in the first position.
Figure 13B:
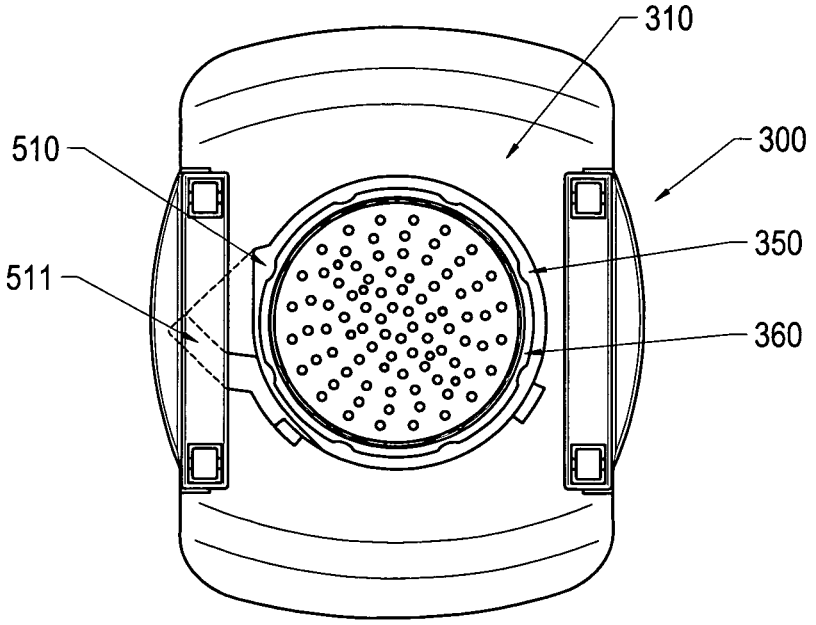
FIG. 13*b* is a state diagram of the index plate of the food cutter according to this invention when it is in the second position.

As shown in FIGS. 3, 13*a* and 15, when the handguard 300 is located at the front end of the slideway 120, the angle of the index plate is 0°. When the handguard 300 is pushed to slide forward to the front blade carrier 210, as the stop 520 is higher than the lower surface of the index plate 510, the stop 520 will prod the shift fork 511 of the index plate to rotate and the index plate 510 will drive the outer rotating cylinder 350 to rotate together with the inner rotating cylinder 360; as shown in FIG. 10, when the index plate 510 rotates by 90°, the shift fork 511 has separated itself from the slide rails 310 and is located right above the slideway 120, that is separated from the stop 520, and now the index plate 510 will not rotate any longer. When the handguard 300 slides back, the shift fork 511 of the index plate is prodded by another stop set on the guides, so that the index plate 510 rotates reversely, thus drives the outer rotating cylinder 350 to rotate reversely together with the inner rotating cylinder 360; when the index plate 510 rotates reversely by 90°, the shift fork 511 of the index plate 510 separates itself from another stop, and now the index plate 510 will not rotate any longer and the handguard 300 returns to the front end of the slideway 120. Thus when the handguard 300 with food passes through the front blade carrier 210 during its slide back and forth along the slideway 120, the food driven by the inner rotating cylinder 360 rotates by 90°, thus the food is cut into various shapes. In this preferred embodiment, the said another stop is the positioning pillar 531 of the stop component described below.

From the above, when the sand 520 is located in different positions on the guides 130, the index plate 510 will rotate by different angles. Therefore, the position of the stop 520 on the guide rails 130 can be set to be adjustable. If the stop is designed on the slider that can slide along the guide rails 130, the position of the stop on the guides is adjusted by adjusting the position of the slider relative to the guide rails 130, thus adjusts the angle the index plate 510 rotates.

Figure 6:
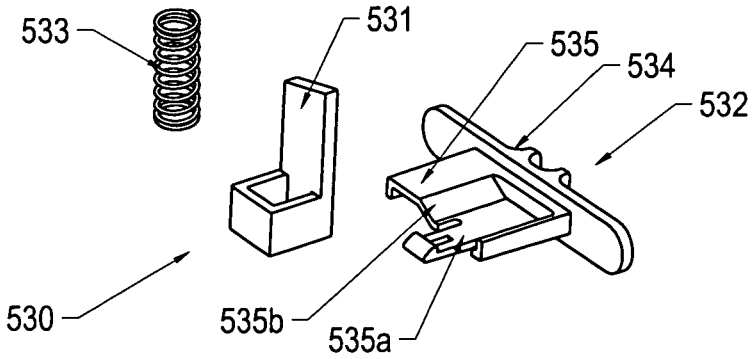
FIG. 6 an explosive view of the retractable stop component on the guides of the food cutter according to this invention.

As shown in FIGS. 6 and 15, in this preferred embodiment, the guide rails 130 are provided with a retractable stop component 530. The stop component 530 comprises a positioning pillar 531 set in the gap 132*a* of the vertical baffle surface, a push rod 532 and a spring 533. The positioning pillar 531 can slide in the direction perpendicular to the sliding surface of the handguard 300; the push rod 532 set inside the guide rails 130 comprises a button 534 that can drive the push rod 532 to slide along the guide rails 130 and a push plate 535 at the bottom of the positioning pillar 531, and the push plate 535 is provided with a plane 535*a* and a slope 535*b*. When pushed, the button 534 of the push rod can drive the push rod 532 to slide back and forth along the guide rails 130, thus drives the push plate 535 of the push rod to slide along the guide rails 130. The slope 535*b* on the push plate drives the bottom of the positioning pillar 531 to rise, thus the top of the positioning pillar 531 extends above the upper surface of the gap 132*a* to form a new stop. The spring 533 is set between the positioning pillar 531 and the support 110, and when the push rod 532 returns and the plane 535*a* of the push plate 535 moves to the bottom of the positioning pillar 531, the spring 533 can make the positioning pillar 531 drop automatically, so that the top of the positioning pillar 531 is lower than the upper surface of the gap 132*a* to change the role as a stop of the positioning pillar 531. Therefore, the stop component 530 forms a movable stop at the gap. Whether the stop is needed depends on the requirement. As shown in FIG. 15, the positioning pillar 531 in the stop component 530 has extended, that is a movable stop has been formed within the gap 132*a*, and the shift fork 511 of the index plate is prodded between the movable stop and the stop, so the index plate 510 can be prodded to rotate by 45° only.

A step 512 can also be set on the index plate 510, and when the positioning pillar 531 in the stop component is uplifted, its top will be higher than the lower surface of the index plate 510 and lower than the step surface of the index plate 510; now a new shift fork 511' different from the shift fork 511 is formed on the step surface of the index plate 510, with the arm length (i.e. the distance from the contact between the shift fork and the stop to the center of rotation) adjustable as required, which can also change the angle the index plate 510 rotates. Multiple steps can be installed on the index plate 510 as required, thus when the positioning pillar 531 in the stop component is uplifted to different degrees of height to match different steps, the index plate 510 can rotate by different angles.

Thus the rotation angle of the index plate 510, i.e. the rotation angle of food, can be selected by adjusting the stop component 530 or prodding the different step surfaces on the index plate 510, and food can be cut into different shapes. For example, the front teeth blade carrier 210*b* is inserted into the front slot 122, the rear teeth blade carrier 210*b'* is inserted into the rear slot 123, and the auxiliary flat blade carrier is snapped in the nick 124 of the slideway 120; when the handguard 300 drives the food to slide through the front teeth blade carrier 210*b*, equally spaced stripes are formed at the bottom of the food; the corresponding stop is adjusted to make the food rotate by 90°; the handguard 300 is pushed to drive the food to pass through the rear teeth blade carrier 210*b'*, and now square grids are formed at the bottom of the food; when the food passes through the auxiliary flat blade carrier, the bottom of the food with grids is cut off to form square resulted food. During the above process, when the corresponding stop is adjusted, so that after the handguard 300 passes through the front teeth blade carrier 210*b*, the index plate 510 drives the food to rotate by 45° and then the food passes through the rear teeth blade carrier 210*b'*, the resulted food will have a rhombic (diamond) shape.

As shown in FIG. 4, in the above case, the rack 100 further comprises supporting legs set beneath the support 110 for supporting the whole rack 100. Preferably, the supporting leg near the front end of the support 110 are set as a supporting tube 112, particularly two supporting arms 113 can be set beneath the support 110 with one end connected to the front end of the support 110, and the supporting tube 112 is fixed between the other ends of the two supporting arms 113 with fasteners; at the same time, the supporting legs set near the rear end of the support 110 are two supporting pillars 114, so that the whole rack 100 is supported by the supporting tube 112 and two supporting pillars 114. It is preferable to install non-slip mats 115 at the bottoms of the supporting tube 112 and the supporting pillars 114 to prevent the rack 100 from slipping easily and provide smooth use. A positioning groove 116 can also be installed on the lower part of the support 110, and the positioning groove 116 can be hung on the container wall, so that the food cut from the slideway 120 directly falls in the container to avoid secondary pollution; in order to adapt to containers of different sizes, multiple positioning grooves 116 can be installed on the lower part of the support 110.

The foregoing description of the preferred embodiments of the present invention has been presented for the purpose of illustration and description. It is not intended to be exhaustive or to limit the invention to the precise form disclosed. Many modifications and verifications are possible in light of the above teaching. It is intended that the scope of the invention be limited not by this detailed description, but rather by the claims appended hereto. Since many embodiments of the present dises in the claims hereafter appended.

What is claimed:

1. An apparatus for cutting food comprising a rack;

at least two cutting devices mounted to said rack at first and second spaced-apart positions;

a holding device adapted for gripping food;

said rack comprising a slideway;

a guiding means adapted to guide the said holding device to slide along the slideway, said guiding means comprises a pair of parallel guide rails installed on two sides of said slideway; and said holding device is provided with a pair of parallel slide rails at the bottom to match with said slide rails for sliding said holding device along said slideway;

wherein said holding device comprises a holding base and a food storage means which is arranged on said holding base, said food storage means comprises an outer shell, an outer rotatable shell nesting within said outer shell, and an inner rotatable shell nesting within said outer rotatable shell, said outer and inner rotatable shells are adapted to axially rotate together relative to said outer shell and a food outlet means mounted to said inner rotatable shell;

wherein said outer rotatable shell having an index plate extending radially away from its axis of rotation; and wherein one of said guide rails having a stop between said first and second spaced-apart positions of said rack that interacts with said index plate when said holding device is slide along said slideway to cause said index plate to rotate said outer rotatable shell, which in turn causes said inner rotatable shell and food stored therein to also rotate.

2. An apparatus for cutting food according to claim 1, wherein at least one roller is mounted between each said slide rail and said guide rail that match each other.

3. An apparatus for cutting food according to claim 1, wherein said inner rotatable shell comprises at least one means adapted for mounting the food inside said inner rotatable shell.

4. An apparatus for cutting food according to claim 3, wherein said food outlet means comprises a connecting member, a pushing member and a pulling member, said pushing member and said pulling member are mounted to the ends of said connecting member, said connecting member passes through an aperture at the end of said inner rotatable shell, said pushing member is positioned outside said inner rotatable shell, said pulling member is positioned inside said inner rotatable shell, said pushing member comprises at least one aperture adapted for passing through by said at least one means adapted for mounting the food inside said inner rotatable shell.

5. An apparatus for cutting food according to claim 1, said stop is adapted to extend through said guiding means, a lifting means for lifting said stop up through said guiding means and a spring, said spring is mounted between said stop and said rack so that said spring is able to move said stop from a first position to a second position.

6. An apparatus for cutting food according to claim 5, wherein said index plate comprises at least one receiving means for receiving said stop.

7. An apparatus for cutting food according to claim 1, wherein the said rack further comprises a body and at least one supporting means adapted to support said rack, wherein said slideway is positioned on said body.

8. An apparatus for cutting food according to claim 7, wherein said at least one supporting means comprises at least one first supporting member positioned at the first end of said body and at least one second supporting member positioned at the second end of said body wherein at least one mounting means for mounting said rack to an object is arranged on the bottom of said body.

* * * * *